US005869439A

United States Patent [19]

Thomas et al.

[11] Patent Number: 5,869,439

[45] Date of Patent: Feb. 9, 1999

[54] HIGH FOAMING NONIONIC SURFACTANT BASED LIQUID DETERGENT

[75] Inventors: Barbara Thomas, Princeton; Gilbert Gomes, Somerset, both of N.J.

[73] Assignee: Colgate Palmolive Company, Piscataway, N.J.

[21] Appl. No.: 947,621

[22] Filed: Oct. 9, 1997

Related U.S. Application Data

[63] Continuation-in-part of Ser. No. 689,328, Aug. 7, 1996, Pat. No. 5,756,441.

[51] Int. Cl.[6] ..... C11D 1/83; C11D 1/22; C11D 3/22; C11D 1/90

[52] U.S. Cl. ..... 510/235; 510/119; 510/123; 510/125; 510/130; 510/138; 510/235; 510/237; 510/405; 510/409; 510/411; 510/414; 510/421; 510/422; 510/426; 510/427; 510/428; 510/470; 510/501

[58] Field of Search ..... 510/119, 123, 510/125, 130, 138, 235, 237, 405, 409, 411, 414, 421, 422, 426, 427, 428, 470, 501

[56] References Cited

U.S. PATENT DOCUMENTS 5,480,586 1/1996 Jakubicki et al. ..... 252/545
5,700,773 12/1997 Jakubicki et al. ..... 510/426

*Primary Examiner*—Mark Kopec
*Assistant Examiner*—Charles Boyer
*Attorney, Agent, or Firm*—Richard E. Nanfeldt; James M. Serafino

[57] ABSTRACT

A high foaming, light duty, liquid detergent with desirable cleansing properties and mildness to the human skin comprising: a water soluble nonionic surfactant at least one water soluble, foaming, anionic surfactant, a zwitterionic surfactant, an alkyl succinamate and the balance being water.

5 Claims, No Drawings

HIGH FOAMING NONIONIC SURFACTANT BASED LIQUID DETERGENT

RELATED APPLICATION

This application is a continuation in part application of U.S. Ser. No. 8/689,328, now U.S. Pat. No. 5,756,441 filed Aug. 7, 1996.

FIELD OF THE INVENTION

The present invention relates to novel light duty liquid detergent compositions with high foaming properties having improved skin feel properties.

BACKGROUND OF THE INVENTION

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the application of nonionic surfactants is limited. There have been substantial interest and efforts to develop a high foaming detergent with nonionic surfactants as the major ingredient. Yet, little has been achieved.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric acid ester salt of an ethylene oxide adduct of a secondary alcohol, and an amphoteric surfactant which may be a betaine, wherein either the anionic or nonionic surfactant may be the major ingredient. The specific class of anionics utilized in this patent is the very same group of anionic detergents expressly excluded in present invention in order to eliminate the alkanol ethoxylate sulfation process and the potential dioxane toxicity problem. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

However, none of the above-cited patents discloses a high foaming, liquid light duty detergent compositions having improved skin feel properties.

SUMMARY OF THE INVENTION

It has now been found that a high foaming liquid detergent can be formulated with a nonionic surfactant which has desirable cleaning properties and mildness to the human skin.

Accordingly, one object of the invention is to provide novel, high foaming, light duty liquid detergent compositions having improved skin feel properties.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the novel, high foaming, light duty liquid detergent of this invention having improved skin feel properties comprises an alkyl monoalkanol amide, a water soluble, ethoxylated, nonionic surfactant, at least one foaming anionic surfactant selected from the group consisting of water soluble organic sulfates and organic sulfonates, a foaming water soluble, zwitterionic surfactant selected from the class of betaines, optionally, an alkyl polyglucoside surfactant, an alkyl succinamate surfactant, and the balance being water wherein the composition does not contain any polyoxyalkylene glycol fatty ester or inorganic detergent builder salts.

More specifically, the present invention relates to a liquid detergent containing a nonionic surfactant selected from the group consisting of water soluble primary aliphatic alcohol ethoxylates secondary aliphatic alcohol ethoxylates, alkyl phenol ethoxylates and alcohol ethylene oxide propylene oxide condensates, at least one anionic surfactant selected from the group consisting of water soluble salts of $C_8$–$C_{18}$ alkyl sulfates, $C_8$–$C_{18}$ ethoxylated alkyl ether sulfates, $C_8$–$C_{16}$ alkyl benzene sulfonates, $C_{10}$–$C_{20}$ paraffin sulfonates and alpha $C_{10}$–$C_{24}$ olefin sulfonates; optionally, a $C_{12}$–$C_{14}$ alkyl monoethanol amide; optionally, a $C_{12}$–$C_{14}$ alkyl diethanol amide; optionally, an alkyl polyglucoside surfactant, a water soluble zwitterionic betaine surfactant and an alkyl succinamate surfactant and the balance being water.

DETAILED DESCRIPTION OF THE INVENTION

The present invention relates to a light duty liquid composition comprising approximately by weight:

(a) 10% to 30%, more preferably 12% to 25% of a nonionic surfactant;

(b) 2% to 10%, more preferably 3% to 8% of a $C_8$–$C_{18}$ alkyl sulfate surfactant;

(c) 0.5% to 10%, more preferably 2% to 9% of a zwitterionic surfactant;

(d) 0.5% to 3.0% of an alkyl monoalkanol amide;

(e) 0.5% to 3.0% of an alkyl dialkanol amide;

(f) 1% to 15% of a solubilizer;

(g) 1% to 5% of an alkyl succinamate; and (h) the balance being water.

The present invention also relates to a light duty liquid composition comprising approximately by weight:

(a) 3% to 18% of a magnesium salt of a linear alkyl benzene sulfonate surfactant;

(b) 0.5% to 10% of a zwitterionic surfactant;

(c) 1% to 16% of an alkyl polyglucoside surfactant;

(d) 4% to 20% of an alkali metal or ammonium salt of a $C_8$–$C_{18}$ ethoxylated alkyl ether sulfate surfactant;

(e) 0 to 10% of a nonionic surfactant;

(f) 1% to 15% of a solubilizer;

(g) 0 to 3% of an alkyl monoalkanol amide;

(h) 1% to 5% of an alkyl succinamate; and (i) the balance being water.

The total amount of surfactants may constitute 17.5%–51%, preferably 20%–40%, most preferably 25%–35%, by weight of the liquid composition. Excluded from the instant compounds are polyoxyalkylene glycol fatty esters, polyhydroxy fatty acid amides, calcium ions, alkyl polyethoxy-polycarbonates, abrasives, polymeric thickeners, clay thickeners, silica, abrasive, clays, alkali metal detergent builder salts, alkali metal carbonates or more than 3 wt. % of a fatty acid or its salt thereof.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing 8 to 18 carbon atoms in a straight or branched chain configuration) condensed with 5 to 30 moles of ethylene oxide, for example, lauryl or myristyl alcohol condensed with 16 moles of ethylene oxide (EO), tridecanol condensed with 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of 8–15 and give good/W emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15- S-9) or 12 EO (Tergitol 15-S-12) marketed by Union Carbide.

Other suitable nonionic surfactants include the polyethylene oxide condensates of one mole of alkyl phenol containing from 8 to 18 carbon atoms in a straight- or branched chain alkyl group with 5 to 30 moles of ethylene oxide. Specific examples of alkyl phenol ethoxylates include nonyl condensed with 9.5 moles of EO per mole of nonyl phenol, dinonyl phenol condensed with 12 moles of EO per mole of phenol, dinonyl phenol condensed with 15 moles of EO per mole of phenol and di-isoctylphenol condensed with 15 moles of EO per mole of phenol. Commercially available nonionic surfactants of this type include Igepal CO-630 (nonyl phenol ethoxylate) marketed by GAF Corporation.

Also among the satisfactory nonionic surfactants are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such surfactants are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being 75% by weight.

Other suitable water-soluble nonionic surfactants which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

The anionic surfactants which may be used in the composition of this invention are water soluble such as triethanolamine and include the sodium, potassium, ammonium and ethanolammonium salts of $C_8$–$C_{18}$ alkyl sulfates such as lauryl sulfate, myristyl sulfate and the like; $C_{8-18}$ ethoxylated alkyl ether sulfates; linear $C_8$–$C_{16}$ alkyl benzene sulfonates; $C_{10}$–$C_{20}$ paraffin sulfonates and alpha olefin sulfonates containing about 10–24 carbon atoms.

The $C_{8-18}$ ethoxylated alkyl ether sulfate surfactants used in the instant composition have the structure:

$$R—(OCHCH_2)_nOSO^-{}_3M^+$$

wherein n is about 1 to about 22 more preferably 1 to 3 and R is an alkyl group having about 8 to about 18 carbon atoms, more preferably 12 to 15 and natural cuts, for example, $C_{12-14}$;$C_{12-15}$ and M is an ammonium cation or an alkali metal cation, most preferably sodium or ammonium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt. %.

The magnesium salt of the sulfonate surfactant are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

The zwitterionic surfactant is a water soluble betaine having the general formula:

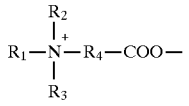

wherein $R_1$ is an alkyl group having 10 to 20 carbon atoms, preferably 12 to 16 carbon atoms, or the amido radical:

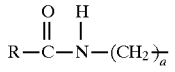

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethyl-ammonia) acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

The alkyl succinamate is used in the composition at a concentration of about 1.0 to about 5 wt. %, wherein the alkyl succinamate is depicted by the formula:

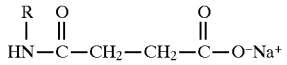

wherein R is a $C_8$ to $C_{18}$ alkyl group.

The instant composition can optionally contain a $C_{12-14}$ alkyl monoalkanol amide such as lauryl monoalkanol amide and/or a $C_{12-14}$ alkyl dialkanol amide such as lauryl diethanol amide or coco diethanol amide.

The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6- positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0;and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, PA. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18(0.5%) and x (degree of polymerization) =1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

All of the aforesaid ingredients in this light duty liquid detergent are water soluble or water dispersible and remain so during storage.

This particular combination of an alkyl polyglucoside surfactant, anionic sulfate surfactant, alkyl succinamate and betaine surfactant, provides a detergent system which coacts with the nonionic surfactant to product a liquid detergent composition with desirable foaming, foam stability, detersive properties and mildness to human skin. Surprisingly, the resultant homogeneous liquid detergent exhibits the same or better foam performance, both as to initial foam volume and stability of foam in the presence of soils, and cleaning efficacy as an anionic based light duty liquid detergent (LDLD) as shown in the following Examples.

The nonionic surfactant, the anionic sulfate surfactant, the betaine surfactant, optionally, the alkyl polyglucoside, optionally, the $C_{12-14}$ alkyl monoalkanol amide, optionally, the $C_{12-14}$ alkyl dialkanol amide and the alkyl succinamate are solubilized in the water. To the composition can also be added water soluble hydrotropic salts include sodium, potassium, ammonium and mono-, di- and triethanolammonium salts of xylene sulfonate or cumene sulfonate. While the aqueous medium is primarily water, preferably said solubilizing agents are included in order to control the viscosity of the liquid composition and to control low temperature cloud clear properties. Usually, it is desirable to maintain clarity to a temperature in the range of 5° C. to 10° C. Therefore, the proportion of solubilizer generally will be from 1%–15%, preferably 2%–12%, most preferably 2%–8%, by weight of the detergent composition with the proportion of ethanol, when present, being 5% of weight or less in order to provide a composition having a flash point above 46° C. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 4.0 wt. % to modify the cloud point of the nonionic surfactant and thereby control the haze of the resultant solution. Various other ingredients such as urea at a concentration of 0.5 to 4.0 wt. % or urea at the same concentration in combination with ethanol at a concentration of 0.5 to 4.0 wt. % can be used as solubilizing agents. Other ingredients which have been added to the compositions at concentrations of 0.1 to 4.0 wt. percent are perfumes, sodium bisulfite, ETDA, isoethanoeic acid and proteins such as lexine protein. The foregoing solubilizing ingredients also facilitate the manufacture of the inventive compositions because they tend to inhibit gel formation.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be a maximum of 5% by weight and preferably less than 2% by weight. Sodium formate can be included in the formula as a perservative at a concentration of 0.1 to 4.0%. Sodium bisulfite can be used as a color stabilizer at a concentration of 0.01 to 0.2 wt. %

The present liquid detergents such as dishwashing liquids are readily made by simple mixing methods from readily available components which, on storage, do not adversely affect the entire composition. The instant composition is prepared by sequentially adding with agitation the nonionic surfactant, anionic sulfate surfactant, the sulfonate surfactant, the betaine surfactant, the alkyl succinamate, optionally, the alkyl polyglucoside, optionally, the $C_{12-14}$ alkyl monoalkanol amide and optionally, the $C_{12}$-14 alkyl dialkanol amide to the aqueous solution of the nonionic surfactant which has been previously mixed with a solubilizing agent such as sodium xylene sulfonate to assist in solubilizing said surfactants, and then adding with agitation the formula amount of water to form an aqueous solution of the nonionic based surfactant system. The use of mild heating (up to 100° C.) assists in the solubilization of the surfactants. The viscosities are adjustable by changing the total percentage of active ingredients. Usually, no thickening agent is added, but thickeners may be added if higher viscosity liquids are desired. In all such cases the product made will be pourable from a relatively narrow mouth bottle (1.5 cm. diameter) or opening, and the viscosity of the detergent formulation will not be so low as to be like water. The viscosity of the detergent desirably will be at least 100 centipoises (cps) at room temperature, but may be up to 1,000 centipoises as measured with a Brookfield Viscometer using a number 3 spindle rotating at 12 rpm. Its viscosity may approximate those of commercially acceptable detergents now on the market. The detergent viscosity and the detergent itself remain stable on storage for lengthy periods of time, without color changes or settling out of any insoluble materials. The pH of this formation is substantially neutral to skin, e.g., 4.5 to 8 and preferably 5.0 to 5.0.

The instant compositions have a minimum foam height of 110 mls after 55 rotation at 40° C. as measured by the foam volume test using 0.75 grams of the composition per liter of water and 1 gram of corn oil per lite of water having a hardness of 300 ppm.

These products have unexpectedly desirably properties. For example, the foam quality and detersive property is equal to or better than standard light duty liquid detergents while using a nonionic surfactant as the primary surfactant and minimal amounts of anionic surfactant, thereby achieving a mild, non-irritating liquid detergent.

The following examples are merely illustrative of the invention and are not to be construed as limiting thereof.

DESCRIPTION OF THE PREFERRED EMBODIMENTS

EXAMPLE 1

The following formulas were prepared at room temperature by simple liquid mixing procedures as previously described

| | A | B |
|---|---|---|
| Neodol 1-9 | 19 | 19 |
| Ammonium Lauryl sulfate | 5.8 | 5.8 |
| Cocoamidopropyl Betaine | 5 | 5 |
| Lauramide diethanol amide | 2.2 | 2.2 |
| Lauryl/Myristyl Monoethanolamide | 1.7 | 1.7 |
| Sodium Xylene Sulfonate | 3.4 | 3.4 |
| Sodium Formate | 2 | 2 |
| $MgSO_4.7H_2O$ | 0.5 | 0.5 |
| Perfume | 0.2 | 0.2 |
| $NaHSO_3$ | 0.05 | 0.05 |
| Dodecyl Succinamate | 0 | 2 |
| Water | Balance | Balance |
| Miniplate | 36.5 | 42.0 |
| Shell Foam FPR | 130 | 128 |
| Foam Volume initial | 275 | 275 |
| Foam Volume with soil | 223 | 232 |

Thirty untrained panelists soaked their hands in 1% and 20% solutions of the above dishwashing liquids at 105° F. for 5 minutes. After 15 minutes, the panelists soaking their hands in Formula B rated their hands softer and smoother and their skin less tight than those soaking in Formula A.

From the performance testing results shown in Table 1, Formula B containing the succinamate show increased foaming properties.

EXAMPLE 2

| | D | E | F | G | H |
|---|---|---|---|---|---|
| Sodium cocosuccinamate | | 2.0 | 1.0 | | |
| Sodium dodecyl-succinamate | | | | 2.0 | 1.0 |
| Magnesium salt of a $C_{10}$-$C_{16}$ linear alkyl benzene sulfonate | 13.6 | 13.6 | 13.6 | 13.6 | 13.6 |
| Cocoamidopropyl Betaine | 7.4 | 7.4 | 7.4 | 7.4 | 7.4 |
| APG625 | 6.8 | 6.8 | 6.8 | 6.8 | 6.8 |
| $NH_4$AEOS(1.3EO) | 7.4 | 7.4 | 7.4 | 7.4 | 7.4 |
| Neodol 1-9 | 6.8 | 6.8 | 6.8 | 6.8 | 6.8 |
| Sodium Xylene Sulfonate | 3.7 | 3.7 | 3.7 | 3.7 | 3.7 |
| Dye Solution | 0.14 | 0.14 | 0.14 | 0.14 | 0.14 |
| Fragrance | 0.45 | 0.45 | 0.45 | 0.45 | 0.45 |
| Water | Balance | Balance | Balance | Balance | Balance |
| pH | 7.0 | 7.0 | 7.0 | 7.0 | 7.0 |
| Lard 1% mgs | 36 | 31 | 25 | 33 | 37 |
| Shell Foam % FPR | 117 | 127 | 129 | 113 | 116 |
| Foam Volume | | | | | |
| initial (ml) | 225 | 228 | 225 | 227 | 223 |
| with soil (ml) | 53 | 47 | 45 | 53 | 50 |

TABLE 3

Skinfeel Additives in Anionic Formulations

| | I | J | K |
|---|---|---|---|
| Sodium cocosuccinamate | | 2.0 | |
| Sodium dodecylsuccinamate | | | 2.0 |
| Magnesium salt of a $C_{10}$-$C_{16}$ linear alkyl benzene sulfonate | 5.4 | 5.4 | 5.4 |
| Cocoamidopropyl Betaine | 4.2 | 4.2 | 4.2 |
| APG625 | 13.6 | 13.6 | 13.6 |
| $NH_4$AEOS(1.3EO) | 16.1 | 16.1 | 16.1 |
| Lauryl/Myristyl Monoethanolamide | 2.0 | 2.0 | 2.0 |
| Sodium Xylene Sulfonate | 3.8 | 3.8 | 3.8 |
| Dye Solution | 0.14 | 0.14 | 0.14 |
| Fragrance | 0.45 | 0.45 | 0.45 |

TABLE 3-continued

| Skinfeel Additives in Anionic Formulations | | | |
|---|---|---|---|
| | I | J | K |
| Water | Balance | Balance | Balance |
| pH | 7.0 | 7.0 | 7.0 |

What is claimed is:

1. A light duty liquid composition comprising by weight:

(a) 3% to 18% of a magnesium salt of a linear alkyl benzene sulfonate surfactant;

(b) 0.5% to 10% of a zwitterionic surfactant;

(c) 1% to 16% of an alkyl polyglucoside surfactant;

(d) 4% to 20% of an alkali metal or ammonium salt of a $C_8$–$C_{18}$ ethoxylated alkyl ether sulfate surfactant;

(e) 6.8% to 10% of a nonionic surfactant formed from the condensation product of a fatty alcohol and ethylene oxide or ethylene oxide and propylene oxide;

(f) 1.7% to 3% of an alkyl monoalkanol amide;

(g) 1% to 5% of an alkyl succinamate;

(h) 1% to 15% by weight of a solubilizing agent which is a water soluble salt of $C_1$–$C_3$ substituted benzene sulfonate hydrotropes; and (i) the balance being water.

2. A liquid detergent composition according to claim 1 wherein said nonionic surfactant is a condensate of a primary $C_8$–$C_{18}$ alkanol with 5–30 moles of ethylene oxide.

3. A liquid detergent composition according to claim 1 further including a preservative.

4. A liquid detergent composition according to claim 1 further including a color stabilizer.

5. A liquid detergent composition according to claim 1 wherein $C_{12-14}$ alkyl monoalkanol amide is a $C_{12-14}$ alkyl monoethanol amide.

* * * * *